US005267503A

United States Patent [19]

Grabner

[11] Patent Number: 5,267,503

[45] Date of Patent: Dec. 7, 1993

[54] AMMUNITION TRANSFER DEVICE

[75] Inventor: Dieter Grabner, Willich, Fed. Rep. of Germany

[73] Assignee: Rheinmetall GmbH, Dusseldorf, Fed. Rep. of Germany

[21] Appl. No.: 929,908

[22] Filed: Aug. 17, 1992

[30] Foreign Application Priority Data

Aug. 16, 1991 [DE] Fed. Rep. of Germany ..... 4127021

[51] Int. Cl.[5] ..... F41A 9/01

[52] U.S. Cl. ..... 89/46

[58] Field of Search ..... 89/36.13, 45, 46, 47

[56] References Cited

U.S. PATENT DOCUMENTS 4,662,265 5/1987 Becker et al. ..... 89/37.09
4,714,004 12/1987 Weinfurth ..... 89/37.09
4,934,271 6/1990 Kensok et al. ..... 89/37.13

FOREIGN PATENT DOCUMENTS 0123012 10/1984 European Pat. Off. .
3132215 3/1983 Fed. Rep. of Germany .
3717857 12/1988 Fed. Rep. of Germany ..... 89/46
3725762 2/1989 Fed. Rep. of Germany ..... 89/46

*Primary Examiner*—Stephen C. Bentley
*Attorney, Agent, or Firm*—Spencer, Frank & Schneider

[57] ABSTRACT

A device for transferring ammunition from a magazine to a transfer arm of an adjustable weapon rotatable about a trunnion. The transfer arm is movable together with the weapon and tilts up to a maximum predetermined angle ($\beta'$) during azimuth adjustment of the weapon. Two angle compensating elements are rotatable relative to one another about a common axis in planes that are inclined by half the predetermined angle ($\beta'/2$) and are operatively disposed adjacent the magazine. A planar turntable is rotatably mounted on the two angle compensating elements for rotation relative thereto about the common axis. The plane of the planar turntable is adjusted by the two angle compensating elements. An ammunition receiving and pivoting device is supported on the turntable for receiving ammunition from the magazine and pivoting the ammunition so that the ammunition can be received by the transfer arm of the weapon.

5 Claims, 5 Drawing Sheets

AMMUNITION TRANSFER DEVICE

BACKGROUND OF THE INVENTION

The present invention relates to an ammunition transfer device for transferring ammunition from a magazine to at least one transfer arm of an azimuth adjustable weapon that is rotatable about a trunnion, and more particularly to such a device in which the ammunition transfer arm moves together with the weapon and tilts up to a maximum predetermined angle $\beta'$ during azimuth adjustment of the weapon.

German Offenlegungsschrift [laid-open patent application] No. 3,132,215, discloses mounting a rotary turret in the chassis of an armored Vehicle by means of a slewing ring, with a weapon, for example a cannon, that is adjustable in elevation being mounted in the rotary turret. In order to realize a low silhouette and a large crew compartment, the slewing ring is arranged within the chassis in an oblique plane with a forward inclination relative to the plane of the bottom of the vehicle so that the oblique plane of the slewing ring is at a predetermined angle to the height axis of the vehicle, the height axis of the vehicle being defined herein as a line normal to the plane of the bottom of the vehicle. When adjusting the azimuth of the turret, the maximum tilt angle of the trunnion axis thus equals the angle of inclination of the slewing ring, which occurs at an azimuth angle of 90° in either direction from the forward direction of the vehicle.

It is also known to provide armored howitzers and the like with an automatic flow of ammunition. In that connection, projectiles are transported by transporting devices from points of removal of the ammunition from a magazine, where the projectiles are taken by loading devices to a position behind the weapon system and finally loaded into the gun barrel by a rammer.

If the ammunition is transported by transfer arms which have holding devices for holding the ammunition and which are pivotal about the trunnions of the gun, the holding devices are able to easily accept the ammunition when the transfer arms are in the pivoted-away position as long as, in every position of the turret, the ammunition is at the same angle as the ammunition component to be picked up and taken from the magazine.

If, however, an obliquely arranged slewing ring is employed which leads to the trunnion axis tilting during azimuth adjustment of the gun, as described above, the transfer arms tilt as well so that, during the automatic flow of ammunition from a magazine to the gun, the corresponding alignment of the ammunition relative to the transfer arms, which would permit the transfer, would not be ensured.

European Patent 0,123,012 and corresponding U.S. Pat. No. 4,662,265 disclose the use of two wedge-shaped, superposed, mutually rotatable rotary discs to horizontally adjust a weapon platform, with the wedge faces of these discs facing one another and carrying the weapon platform.

SUMMARY OF THE INVENTION

It is an object of the present invention to provide a transfer device of the type first described above which permits an automatic flow of ammunition in a simple manner and without loss of time and cadence between a magazine and a gun while compensating for the tilt of the transfer arms which tilt together with the gun when the gun azimuth is adjusted.

The above and other objects are accomplished in the context of a transfer arm of the type first described above wherein there is additionally provided two angle compensating elements rotatable relative to one another about a common axis in planes that are inclined by half the predetermined angle ($\beta'/2$) and operatively disposed adjacent the magazine; a planar turntable rotatably mounted on the two angle compensating elements for rotation relative thereto about the common axis, the plane of the planar turntable being adjusted by the two angle compensating elements; and an ammunition receiving and pivoting device supported on the turntable for receiving ammunition from the magazine and pivoting the ammunition so that the ammunition can be received by the transfer arm of the weapon.

The invention will now be described in greater detail with reference to an embodiment thereof that is illustrated in the attached drawing figures.

DESCRIPTION OF PREFERRED EMBODIMENTS

Figure 1:
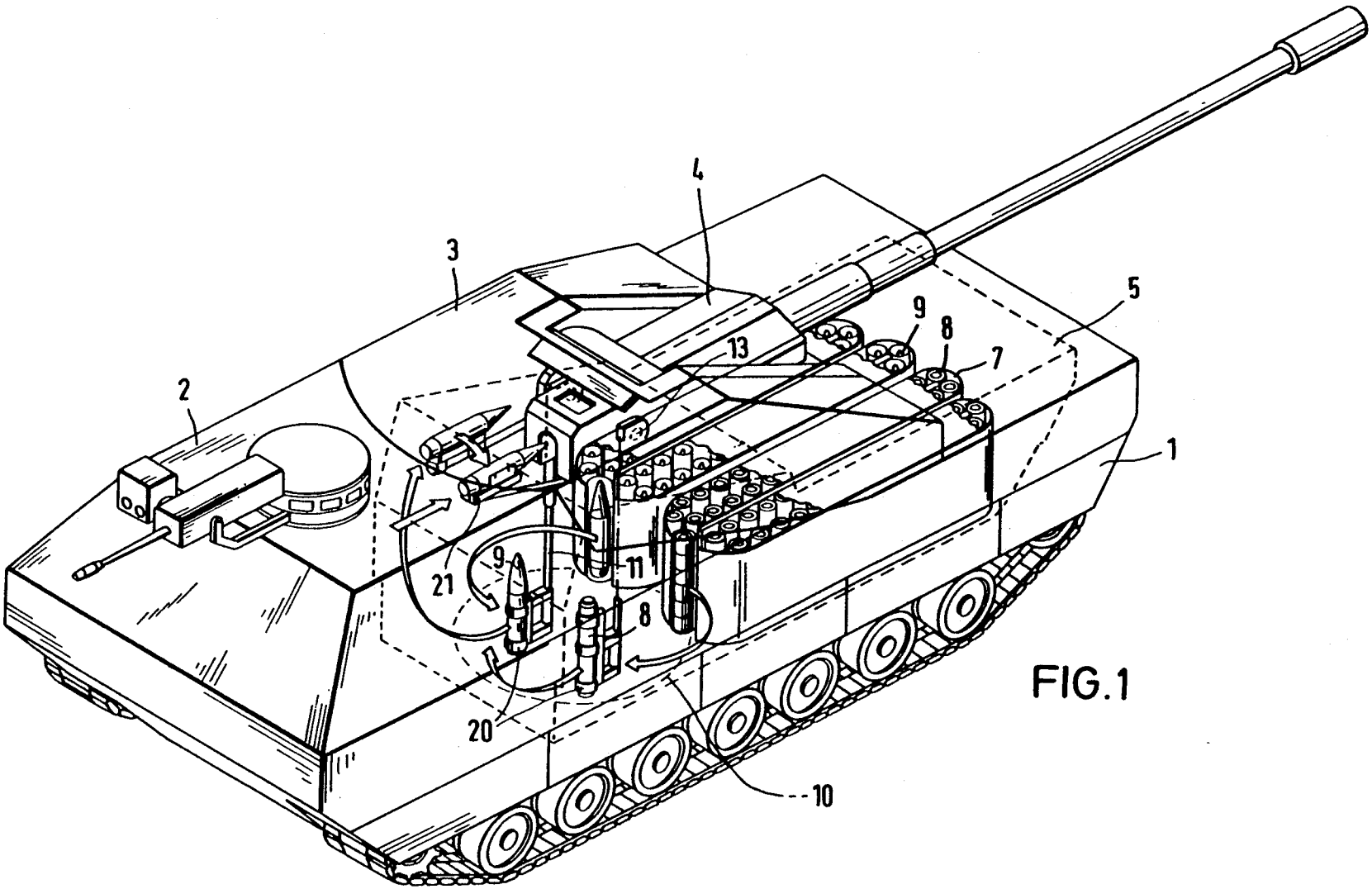
FIG. 1 is a perspective view of an armored howitzer.

The armored howitzer shown in FIG. 1 comprises a vehicle cradle 1 including at its rear end a crew compartment 2 that is fixed to the cradle, a turret 3 including a gun 4 and an unmanned combat chamber 5 which, in the illustrated embodiment, includes two rotary chain magazines 7 that are fixed to the cradle and are arranged parallel to the longitudinal axis 6 of the vehicle for storing ammunition components including propelling charges 8 and projectiles 9. A transfer device 10 is arranged for transferring ammunition components 8 and 9 to transfer arms 11 which are arranged to rotate about trunnions 13 of gun 4.

Figure 3:
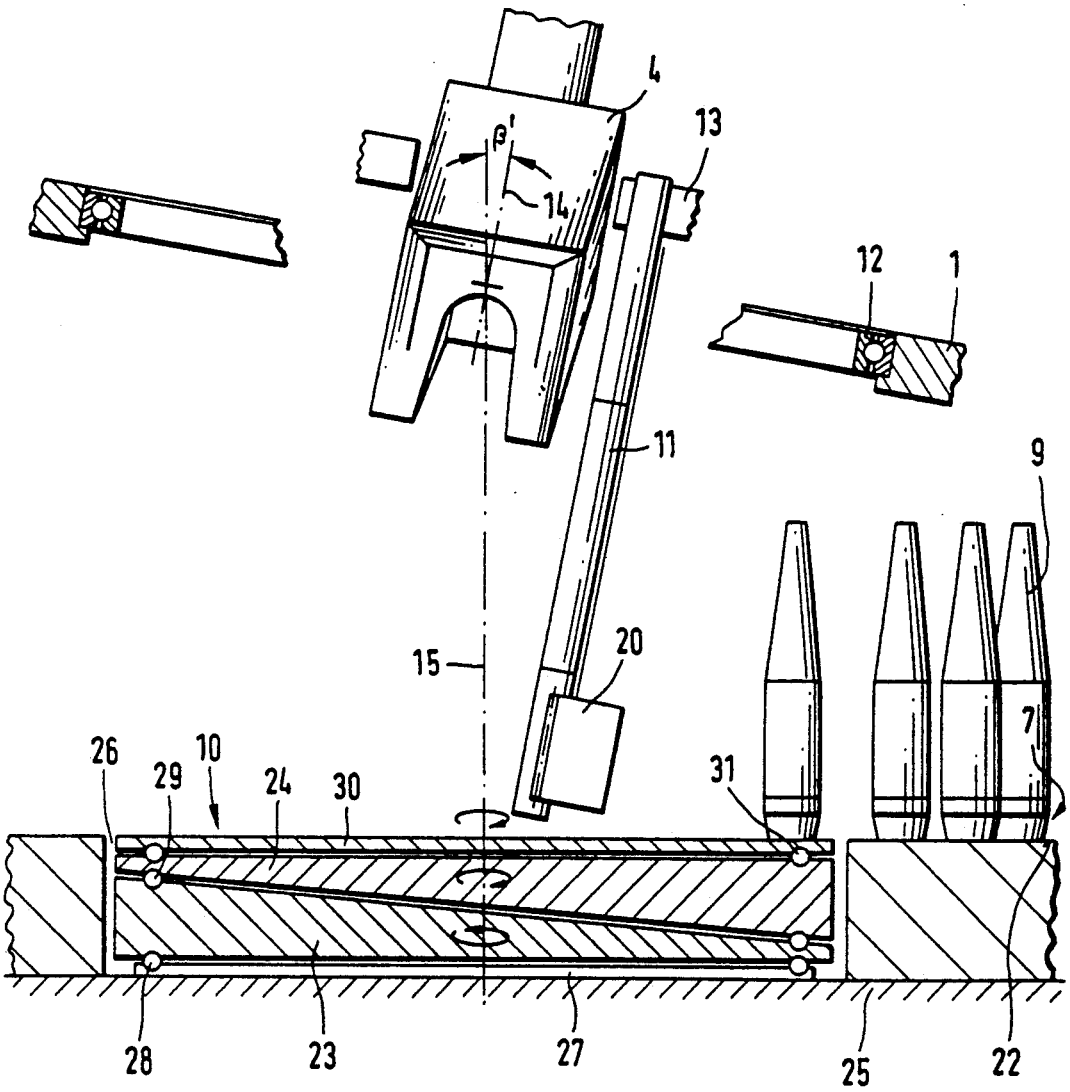
FIGS. 3 to 5 are schematic representations of various phases of the transfer of a projectile by a transfer device in accordance with the invention.
Figure 4:
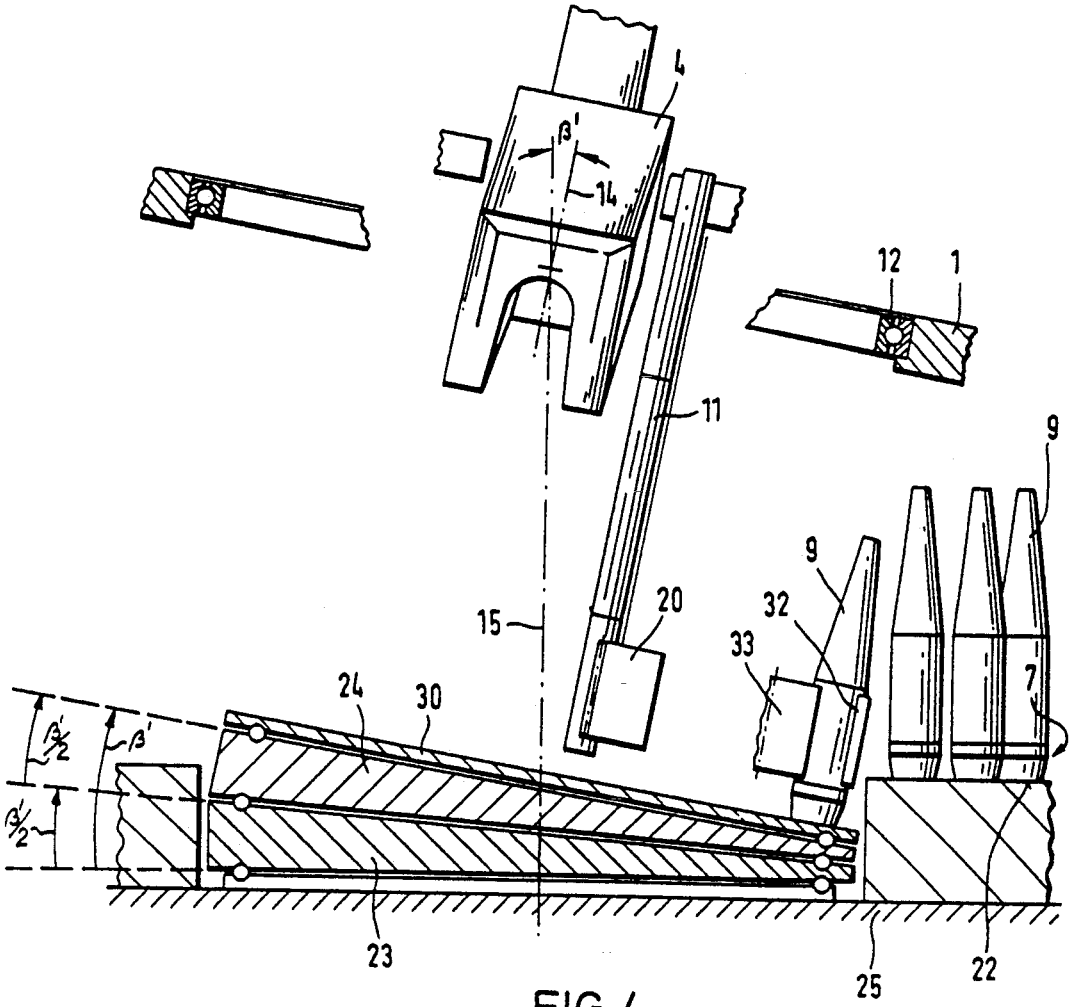
Figure 5:
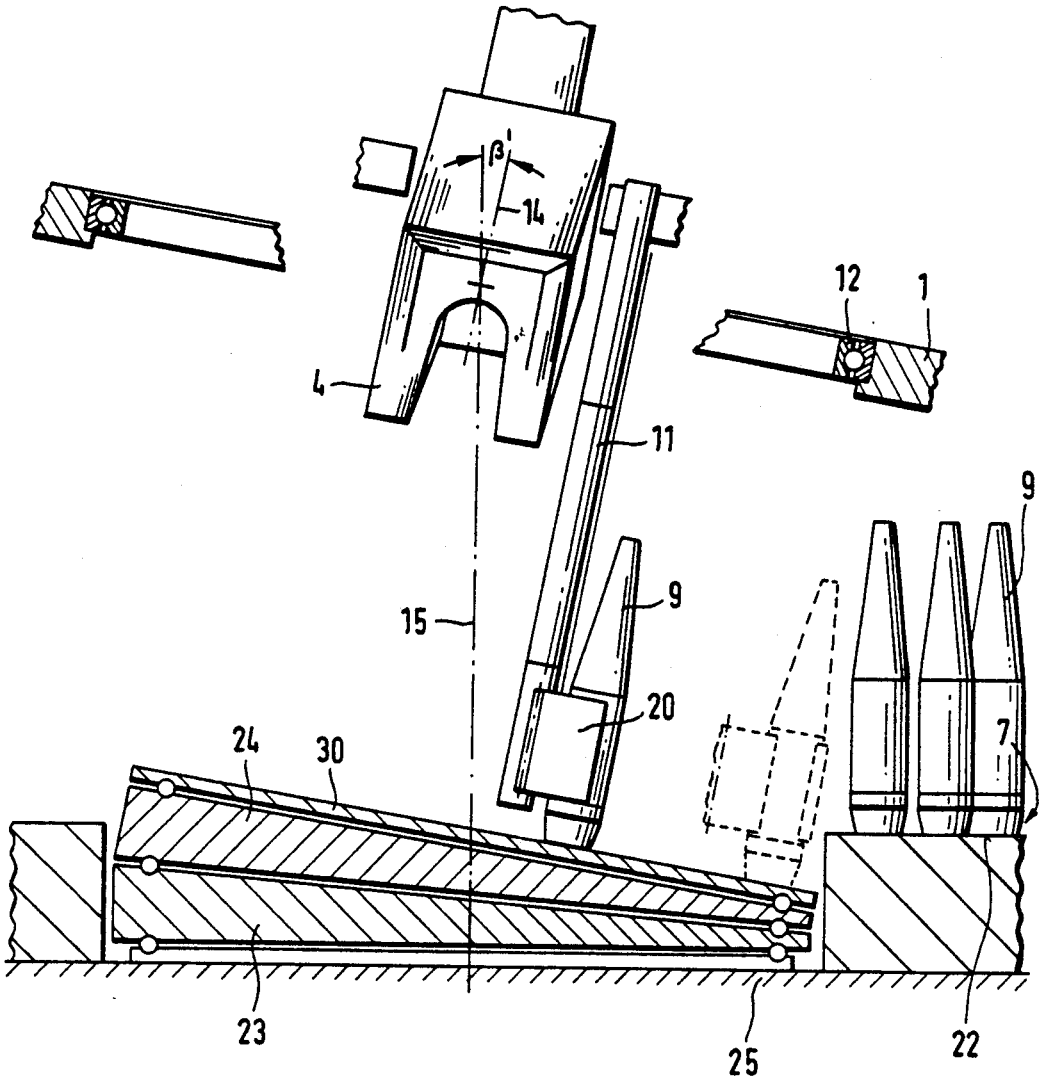

Turret 3 includes a slewing ring 12 which is fixed in vehicle cradle 1 so that it is inclined forward in an oblique plane forming a predetermined angle with the height axis 15 of the vehicle as previously discussed. During an azimuth adjustment of turret 3, trunnion 13 (about which transfer arms 11 rotate) tilts, in dependence of the azimuth adjustment pivot angle set between and 0° and 90° during aiming, through an angle $\beta$ developed between axis 14 of slewing ring 12 and vehicle height axis 15. At 90° of azimuth pivot, angle $\beta$ assumes a maximum value $\beta'$ as shown in FIGS. 3–5, corresponding to the forward angle of inclination of slewing ring 12. At 0° of azimuth pivot, the azimuth pivot axis, i.e., axis 14, of trunnion 13 is not tilted and is in the same plane as height axis 15.

Figure 2:
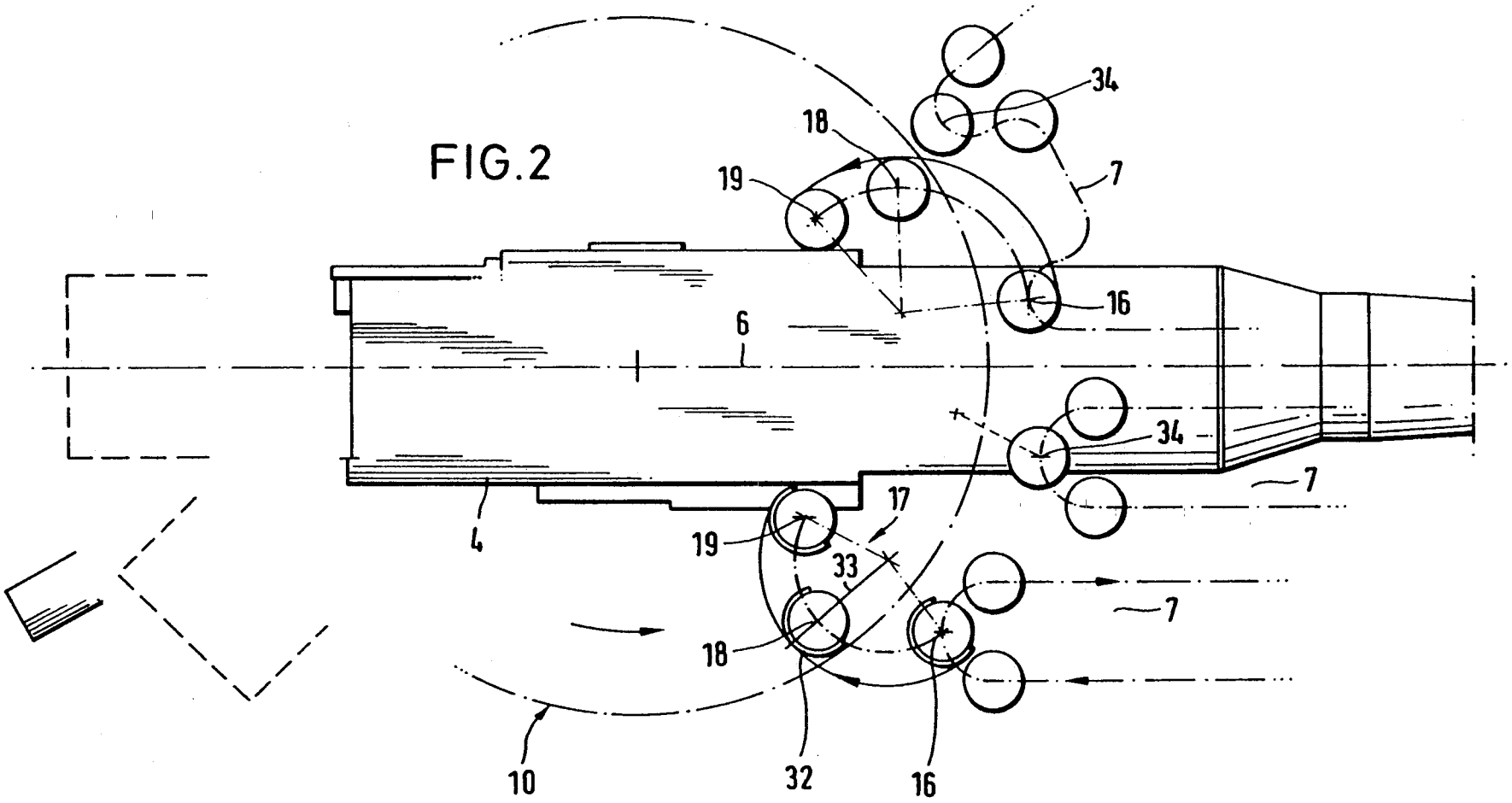
FIG. 2 is a schematic top view of the flow of ammunition in the armored howitzer of FIG. 1.

Magazines 7 each have a removal position 16 for a projectile 9 or a propelling charge 8 (which may comprise a predetermined number of propelling charge modules) in which they are received by an associated receiving and pivoting device 17, shown generally in FIG. 2, in order to be initially pivoted into a waiting position 18 and then into a transfer position 19 at the associated transfer arm 11 which receives ammunition components 8 and 9, respectively, by means of appropriate holders 20 and transfers them to a rammer 21.

In order to compensate for the tilt of axis 14 relative to vehicle height axis 15 as it occurs during adjustment of the azimuth of gun 4, transfer device 10 is disposed in an essentially circular recess between the bottoms 22 of magazines 7. Transfer device 10 includes two superposed and mutually rotatable platforms in the form of wedge-shaped elements 23 and 24, each having a wedge angle $\beta'/2'$, (see FIG. 4) and with their wedge faces 23' and 24' facing one another. Wedge-shaped elements 23 and 24 are arranged on the bottom 25 of vehicle cradle 1 so as to rotate by means of drives (not shown) about the vehicle height axis 15. At the bottom of recess 26 there is provided a bearing plate 27 on which the lower wedge-shaped element 23 is mounted by way of a bearing 28 while a bearing 29 is disposed between the two coaxial wedge-shaped elements 23 and 24.

A plate-shaped platform 30 is arranged coaxially with wedge-shaped elements 23 and 24 on upper wedge-shaped element 24. Plate-shaped platform 30 is rotatable about vehicle height axis 15 relative to platform 24 by means of a drive (not shown) and is supported by a bearing 31.

Plate-shaped platform 30 is equipped with two receiving and pivoting devices 17 each of which is provided with a pivot arm 33 carrying a holder 32 for ammunition components 8 and 9, respectively.

FIG. 3 is a simplified illustration of a projectile 9 standing on plate-shaped platform 30. Although not shown in FIG. 3, projectile 9 is held by a gripper 32 of pivot arm 33 (see FIGS. 2 and 4) in its waiting position 18 after removal from magazine 7. As shown in FIG. 3, transfer device 10 is in a position in which plate-shaped platform 30 is flush with bottoms 22 of magazines 7 while an angle $\beta'$ exists between axes 14 and 15, with the result that transfer arm 11 is sloped relative to the longitudinal axis of projectile 9 in the waiting position.

In accordance with the principles of the invention, rotation of wedge-shaped elements 23 and 24 relative to one another causes plate-shaped platform 30 and projectile 9 disposed thereon (as well as any propelling charges 8 likewise disposed thereon but not shown) to be set at an angle. This rotation takes place in such a way that axis 14, which is parallel to gun axis becomes parallel with the axis of the propelling charge because the angle of platform 30 is caused to change in correspondence with the azimuth adjustment of gun 4 as shown in FIG. 4. Both pivot arms 33, which have pivot axes 33' perpendicular to plate-shaped platform 30, can then pivot into the transfer position at the respective transfer arm 11 in order to transfer ammunition components 8 and 9 for loading gun 4 as shown in FIG. 5. Desirably, the follow-up of platform 30 is preferably effected during the compensation process, that is, during the rotation of wedge-shaped elements 23 and 24 relative to one another so that ammunition components 8 and 9 are properly oriented by the time they are pivoted by pivot arms 33 into position to be received by holders 20.

After transfer of ammunition 8 and 9, pivot arms 33 pivot backward and make room for the movement of transfer arms 11. Thereafter, the process takes place in the reverse order until wedge-shaped elements 23 and 24 have horizontally adjusted plate-shaped platform 30 to the level of the bottoms 22 of magazines 7 so that new ammunition components 8 and 9, which in the meantime have already been transported from the magazines 7 to removal position 16, can be received on plate-shaped platform 30 by grippers 32.

To increase the cadence and the redundancy of the flow of ammunition, a further removal position 34 may be provided for magazines 7.

Instead of the wedge-shaped elements 23 and 24, roller bearings equipped with roll planes that lie at an angle $\beta'/2$ to one another may also be employed in which case the forces of the mutually rotatable planes attack at the point of penetration of axis 15 through the top face of plate-shaped platform 30 in order to prevent lateral displacements of the latter.

Obviously, numerous and additional modifications and variations of the present invention are possible in light of the above teachings. It is therefore to be understood that within the scope of the appended claims, the invention may be practiced otherwise than as specifically claimed.

What is claimed is:

1. In a device for transferring ammunition from a magazine to a transfer arm of an adjustable weapon rotatable about a trunnion, the transfer arm being movable together with the weapon and tilting up to a maximum predetermined angle ($\beta'$) during azimuth adjustment of the weapon, the improvement comprising:

two angle compensating elements rotatable relative to one another about a common axis in planes that are inclined by half the predetermined angle ($\beta'/2$) and operatively disposed adjacent the magazine;

a planar turntable rotatably mounted on said two angle compensating elements for rotation relative thereto about the common axis, the plane of said planar turntable being adjusted by said two angle compensating elements; and an ammunition receiving and pivoting device supported on said turntable for receiving ammunition from the magazine and pivoting the ammunition so that the ammunition can be received by the transfer arm of the weapon.

2. A transfer device as defined in claim 1, wherein said receiving and pivoting device includes a pivot arm which has a gripper for gripping ammunition and which is pivotal relative to said planar turntable about a pivot axis that is perpendicular to said planar turntable.

3. A transfer device as defined in claim 1, wherein said weapon has a non-tilted azimuth adjustment axis which is in the same plane as the common axis of said turntable and said two angle compensating elements.

4. A transfer device as defined in claim 1, further including means for coupling rotation of said turntable with movement of said two angle compensation elements.

5. A transfer device as defined in claim 1, wherein said two angle compensation elements comprise wedges.

* * * * *